US007637691B1

(12) United States Patent
DiTullio

(10) Patent No.: US 7,637,691 B1
(45) Date of Patent: Dec. 29, 2009

(54) MULTIPLE LAYER WALL WATER STORAGE CHAMBERS

(76) Inventor: Robert J. DiTullio, 170 Lake Rd., Warren, CT (US) 06754

( * ) Notice: Subject to any disclaimer, the term of this patent is extended or adjusted under 35 U.S.C. 154(b) by 0 days.

(21) Appl. No.: 12/171,884

(22) Filed: Jul. 11, 2008

(51) Int. Cl.
*E02B 13/00* (2006.01)

(52) U.S. Cl. ..... 405/49; 405/46

(58) Field of Classification Search ..... 405/43–51, 405/36

See application file for complete search history.

(56) References Cited

U.S. PATENT DOCUMENTS

| | | | | |
|---|---|---|---|---|
| 3,367,370 | A | 2/1968 | Sherlock | |
| 3,440,823 | A | 4/1969 | Olsen | |
| 3,830,373 | A * | 8/1974 | Sixt | 405/49 |
| 3,976,578 | A * | 8/1976 | Beane | 405/49 |
| 4,523,613 | A | 6/1985 | Fouss et al. | |
| 4,930,936 | A * | 6/1990 | Hegler et al. | 405/49 |
| 4,950,103 | A * | 8/1990 | Justice | 405/49 |
| 5,036,210 | A | 7/1991 | Goodman | |
| 5,087,155 | A | 2/1992 | Herman et al. | |
| 5,532,598 | A | 7/1996 | Clark, Jr. et al. | |
| 5,921,711 | A * | 7/1999 | Sipaila | 405/49 |
| 6,126,209 | A * | 10/2000 | Goddard | 285/347 |
| 6,679,653 | B1 * | 1/2004 | DiTullio | 405/49 |
| 6,854,925 | B2 | 2/2005 | DiTullio | |
| 7,451,784 | B2 * | 11/2008 | Goddard | 405/49 |
| 2004/0101369 | A1 * | 5/2004 | DiTullio | 405/49 |

* cited by examiner

*Primary Examiner*—Frederick L Lagman
(74) *Attorney, Agent, or Firm*—St. Onge Steward Johnston & Reens LLC

(57) ABSTRACT

A storm water and septic system using plastic galleries that have multiple layers provided having differing hardness characteristics, the exterior layer having a lower hardness rating than an inner layer; and a multi-layer gallery where the inner layer is treated to be resistance to degradation to a selected chemical that would otherwise degrade polyethylene. The gallery may further be provided with an interior layer having defined dielectric properties such that a fluid level measurement can be made of fluid in the galleries.

27 Claims, 9 Drawing Sheets

MULTIPLE LAYER WALL WATER STORAGE CHAMBERS

FIELD OF THE INVENTION

The present invention relates to pre-molded galleries utilized for storm-water and septic systems, which minimize the damage that may potentially be inflicted to the chamber during installation and use.

BACKGROUND OF THE INVENTION

Storm water and septic systems have been in wide use for many years, including for example, pre-molded polyethylene galleries. An advantage to utilizing these galleries is that they are lightweight, easy and quick to install and relatively inexpensive.

Pre-molded polyethylene galleries have increasingly been utilized for leaching and drainage systems. Such a system is disclosed in U.S. Pat. No. 5,087,155 to DiTullio ("the '155 patent"), the disclosure of which is incorporated by reference, which discloses a drainage and leaching field system comprising vacuum-molded polyethylene galleries that are designed to be connected and locked together in and end-to-end fashion.

The galleries disclosed in the '151 patent comprise a single pre-molded polyethylene layer with an arch-shaped configuration having upstanding ribs running transverse to the length of the gallery. The ribs provide compressive strength to the gallery where, often it is desired to install the galleries under parking areas and under roadways. However, because the galleries are made of only a single layer the rocks and or debris falling into or on the gallery during, for example, installation, can cause damage to the gallery. Additionally, where the galleries are exposed to, for example, a warm or hot caustic such as may be encountered at a chemical treatment plant, the structural integrity of the gallery can be compromised if the chemical causes damage to the walls of the gallery. Additionally, it is virtually impossible to determine a level of fluid in the gallery without direct visualization of the interior of the gallery.

U.S. Pat. No. 6,854,925 to DiTullio ("the '925 patent"), the disclosure of which is also incorporated by reference, discloses a multi-layer plastic gallery including a first exterior layer forming a smooth continuous surface along a substantial length of the gallery; a second middle layer forming a plurality of spaced apart upstanding ribs along a length of the gallery; and a third interior layer forming a smooth continuous surface along a second substantial length of the gallery. The '925 patent further discloses that one benefit of the configuration is that it allows for a low-friction surface on the interior walls for the quick removal of storm water runoff. While the smooth inner wall does present a reduced friction surface, the problem of providing a gallery capable of withstanding damage due to, for example, rocks or other heavy objects impacting the surface of the gallery during installation is still a factor.

For example, while providing a multi-layer walled structure will provide additional strength to the gallery, the exterior layer and possibly the middle corrugated support layer may become damaged (e.g. cracked) if a large object impacts the exterior of the gallery. Additionally, the galleries disclosed in the '925 patent do not allow or provide for a remote determination of a level of fluid in the gallery without direct visualization or the insertion of an instrument to perform the measurement.

SUMMARY OF THE INVENTION

What is desired therefore, is a gallery that minimizes any damage that may occur to the gallery due to impact of a relatively heavy object against the gallery, such as a rock.

It is also desired to provide a gallery that minimizes any damage that may occur to the gallery during use caused from the exposure of the gallery to a corrosive chemical, such as for example, a warm or hot caustic.

It is still further desired to provide a gallery that allows for the remote measurement of a fluid level in the gallery without the need for direct visualization or the need for insertion of an external or internally mounted sensor.

These and other objects are achieved in one embodiment by the provision of a gallery having at least two layers where an exterior layer is provided having a lower hardness rating than a stiffer inner layer. This configuration provides the distinct advantage that if a relatively large or heavy object impacts the exterior surface of the gallery, rather than cracking or shattering, the exterior layer is provided to absorb the impact and protect the harder or stiffer inner layer. It is contemplated that the inner layer can be provided as a stiffer and/or harder layer having higher strength characteristics to ensure stability for the drainage system when buried. It is contemplated that both the exterior and inner layers may comprise a polyethylene material, however, the inner layer may be treated to increase the hardness of the polyethylene, such as for example, with talc.

While the gallery is provided having at least two layers, the layers may be co-extruded to form a unitary sheet that may then be formed into a gallery. The extruded unitary sheet may then be inserted into a mold to form a chamber. While the embodiment is described as comprising at least two co-extruded layers, it is contemplated that numerous layers may be used and/or co-extruded to form a single unitary sheet for use in forming chambers.

In another embodiment, it is contemplated that the gallery may be provided with a first layer comprising a corrugated polyethylene material, and a protective inner layer that is treated to resist chemicals that are corrosive to polyethylene. For example, the inner layer may comprise a polyethylene material that is treated to resist a warm or hot caustic that would normally cause damage to the polyethylene material. The protective inner layer could be provided as a relatively thin layer that substantially follow the contour of the corrugated first layer, or could comprise a relatively thin layer that presents a smooth interior surface. In any event, the layer would be treated to resist degradation due to exposure to a particular chemical. In this manner, the corrugated first layer that provides structural stability to the gallery will not be compromised due to exposure to a caustic substance.

In yet another embodiment, a gallery is provided comprising a material having dielectric or magnetic properties. For example, it is know to determine the Dielectric Constant (DC) of a material for various purposes. In this application, a DC conductivity measurement may be used to measure the level of a liquid in the gallery. The DC of a material is a ratio of how much Radio Frequency energy will pass through it compared to that amount that will pass through empty space (DC=1.0). Therefore, polyethylene plastic (DC=2.2 at 68° F. in a solid state) will pass 2.2 times as much R.F. energy as will a vacuum. Accordingly, DC conductivity measurements using R.F./admittance and pulse wave technology can be used for liquid level measurements.

Accordingly, it is contemplated that a gallery having an inner polyethylene layer can be used to determine the level of a liquid residing in the gallery at a particular temperature by performing a DC conductivity measurement. It is contemplated that an inner layer may be used on one or more galleries coupled to together in an end-to-end fashion and/or in various columns and rows to determine a liquid level throughout the gallery field. The dielectric measurement could be used to generate a level signal indicative of a level of fluid in the gallery, which could be sent to either a local or remote location for monitoring.

The gallery may be provided as an elongated arched body including multiple layers where a top portion or at least an upper surface of the body is provided having a relatively light color, such as for example, white. In this manner, when the galleries are maintained exposed to heating sources, such as the sun for prolonged periods of times, rather than absorbing large amounts of energy that heat the gallery and thereby cause the gallery to become more pliable, a larger amount of energy is deflected away from the gallery. This allows the gallery to maintain its shape and stiffness as the temperature is not dramatically increased.

Still further, a metallic portion may be positioned in the gallery, which may advantageously be located at a top portion of the gallery. In this manner, when the galleries are buried, the metallic portion allows an individual to locate the buried galleries by simply using a metal detector.

In one advantageous embodiment a multi-layer gallery having an elongated arched body and first and second ends, the elongated arched body forming an elongated arched interior space with an open bottom for liquid to flow therethrough is provided comprising a first exterior layer having a hardness ($H_1$) that extends the substantially the length of the gallery and a second inner layer forming a plurality of spaced apart upstanding ribs along a length of the gallery, the second layer having a hardness ($H_2$). The gallery is provided such that the hardness ($H_1$) of the first exterior layer is lower than the hardness ($H_2$) of the second inner layer. The gallery further comprises a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

In another advantageous embodiment a multi-layer polyethylene gallery having an elongated arched body and first and second ends, the elongated arched body forming an elongated arched interior space with an open bottom for liquid to flow therethrough is provided comprising a first exterior layer forming a plurality of spaced apart upstanding ribs along a length of the gallery and a second inner layer extending substantially the length of the gallery. The gallery is provided such that the second inner layer is treated to resist degradation by a selected substance that is caustic to polyethylene so that the multi-layer polyethylene gallery can be used to disperse substances that may be harmful to polyethylene without degradation to the gallery. The gallery further comprises a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

In still another advantageous embodiment a multi-layer gallery having an elongated arched body and first and second ends, the elongated arched body forming an elongated arched interior space with an open bottom for liquid to flow therethrough is provided comprising a first exterior polyethylene layer forming a plurality of spaced apart upstanding ribs along a length of the gallery and a second inner polyethylene layer having a know Dielectric Constant (DC) at a given temperature. The gallery further comprises a DC conductivity measurement of the second inner polyethylene layer that is indicative of a level of liquid in the gallery at a given point in time and a level signal generator receiving the DC conductivity measurement and generating a level signal corresponding to the level of liquid in the gallery. The gallery still further comprises a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

In yet another advantageous embodiment a multi-layer gallery having an elongated arched body and first and second ends, the elongated arched body forming an elongated arched interior space with an open bottom for liquid to flow therethrough is provided comprising a first exterior layer having a hardness ($H_1$) that extends the substantially the length of the gallery and a second inner layer forming a plurality of spaced apart upstanding ribs along a length of the gallery, the second layer having a hardness ($H_2$). The gallery is provided such that the hardness ($H_1$) of the first exterior layer is lower than the hardness ($H_2$) of the second inner layer. The gallery further comprises a third interior layer extending substantially the length of the gallery where the third interior layer is treated to resist degradation by a selected substance that is caustic to polyethylene such that the multi-layer polyethylene gallery can be used to disperse substances that may be harmful to polyethylene without degradation to the gallery. The gallery still further comprises a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

In still another advantageous embodiment a multi-layer gallery having an elongated arched body and first and second ends, the elongated arched body forming an elongated arched interior space with an open bottom for liquid to flow therethrough is provided comprising a first exterior layer having a hardness ($H_1$) that extends the substantially the length of the gallery and a second inner layer forming a plurality of spaced apart upstanding ribs along a length of the gallery, the second layer having a hardness ($H_2$). The gallery is provided such that the hardness ($H_1$) of the first exterior layer is lower than the hardness ($H_2$) of the second inner layer. The gallery further comprises a third interior polyethylene layer having a know Dielectric Constant (DC) at a given temperature. The gallery still further comprises a DC conductivity measurement of the third interior polyethylene layer that is indicative of a level of liquid in the gallery at a given point in time and a level signal generator receiving the DC conductivity measurement and generating a level signal corresponding to the level of liquid in the gallery. The gallery yet further comprises a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

Other objects of the invention and its particular features and advantages will become more apparent from consideration of the following drawings and accompanying detailed description.

DETAILED DESCRIPTION OF THE INVENTION

Figure 1:
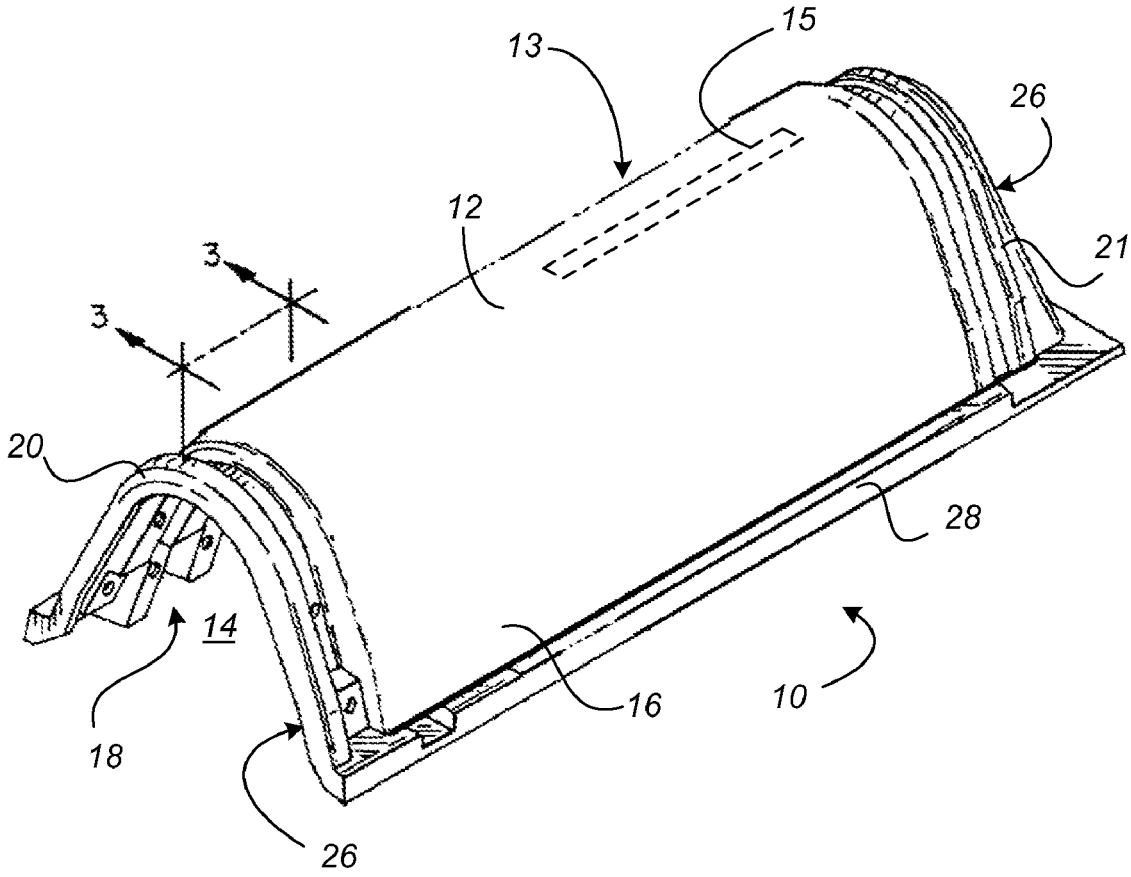
FIG. 1 is a perspective view of one embodiment of the present invention showing the multiple layers.

Referring now to the drawings, wherein like reference numerals designate corresponding structure throughout the views.

FIG. 1 is an illustration of a first embodiment of the present invention, having a multi-wall construction. A plastic gallery 10 is shown, having an elongated section 12 that forms an interior space 14. The gallery 10 comprises and exterior layer 16 that forms a smooth continuous surface over the outside of the gallery and terminates at the bottom portion of the gallery 10 with a flange 28. The gallery 10 also includes an inner layer 18 running transversely to the length of the elongated section 12 forming a plurality of spaced apart upstanding ribs 20.

Figure 2:
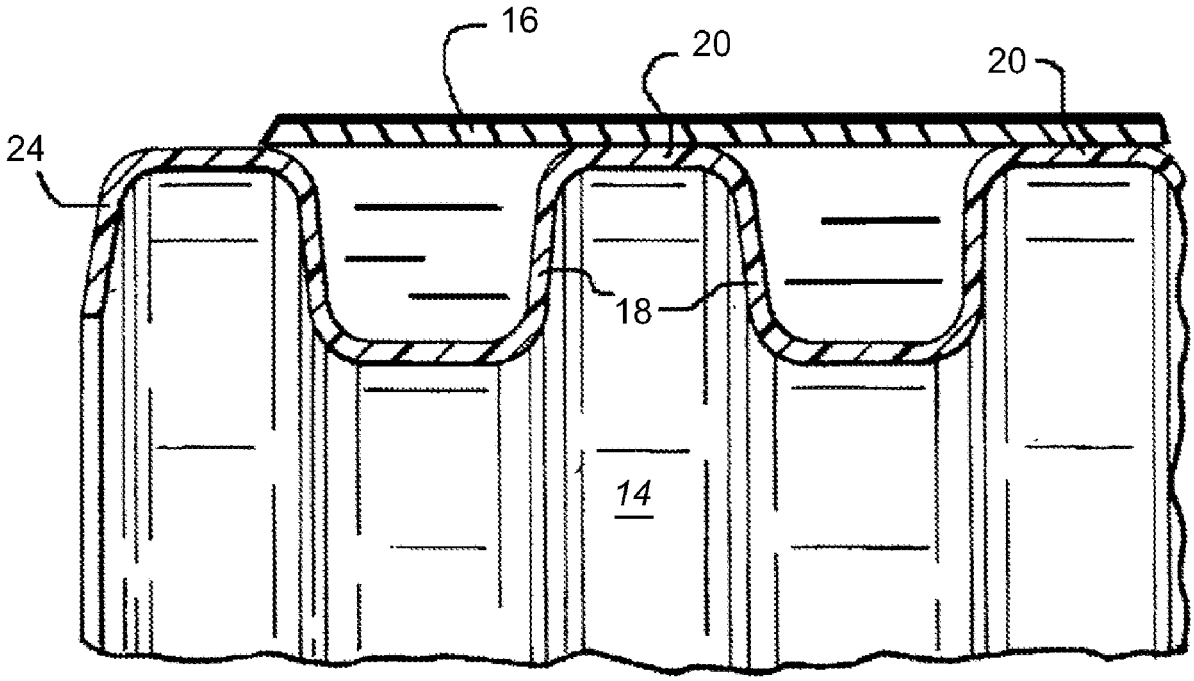
FIG. 2 is a cross-sectional view of the section of FIG. 1 along line 4-4.

FIG. 2 is a cross-section of FIG. 1, illustrating the present invention with the exterior layer 16 and the inner layer 18. It is not required that the exterior layer 16 extend the entire length of the elongated section 12. Rather, the exterior layer 16 may extend from the first end 24 and may be terminated before the second end 26 of the elongated section 12 thereby exposing, for example, at least one upstanding rib 21 at the second end 26, or alternatively conforms to the shape of the ribbed inner layer 18. The upstanding rib 20 at the first end 24 is larger than exposed rib 21 at second end 26 to facilitate the connection of galleries 10 in an end-to-end fashion as the upstanding rib 20 at the first end 24 of a first gallery 10 is fitted over the exposed upstanding rib 21 at the second end 26 of a second gallery 10, thereby mating two galleries 10 together in an end-to-end relationship. Alternatively, the gallery 10 may have multiple exposed upstanding ribs located at each end of the gallery 10.

It is contemplated that exterior layer 16 is provided having a lower hardness rating than a stiffer inner layer 18. In this manner, if during installation a relatively heavy object where to impact the gallery 10, the object would contact exterior layer 16, which is provided with a lower hardness rating so as to bend or give to avoid cracking or shattering. The inner layer 18, however, can be provided having higher strength characteristics to ensure stability for the drainage system during loading. Both the exterior layer 16 and inner layer 18 may comprise a polyethylene material, however, inner layer 18 may be treated with, for example, talc, to increase the hardness of the polyethylene.

It should be noted that gallery 10 may be provided comprising both exterior layer 16 and inner layer 18, however these layers may be co-extruded to form a unitary sheet to then be formed into gallery 10. While at least two co-extruded layers are described here, it is contemplated that additional layers may be used and/or co-extruded to form a single unitary sheet for use in forming gallery 10.

Figure 3:
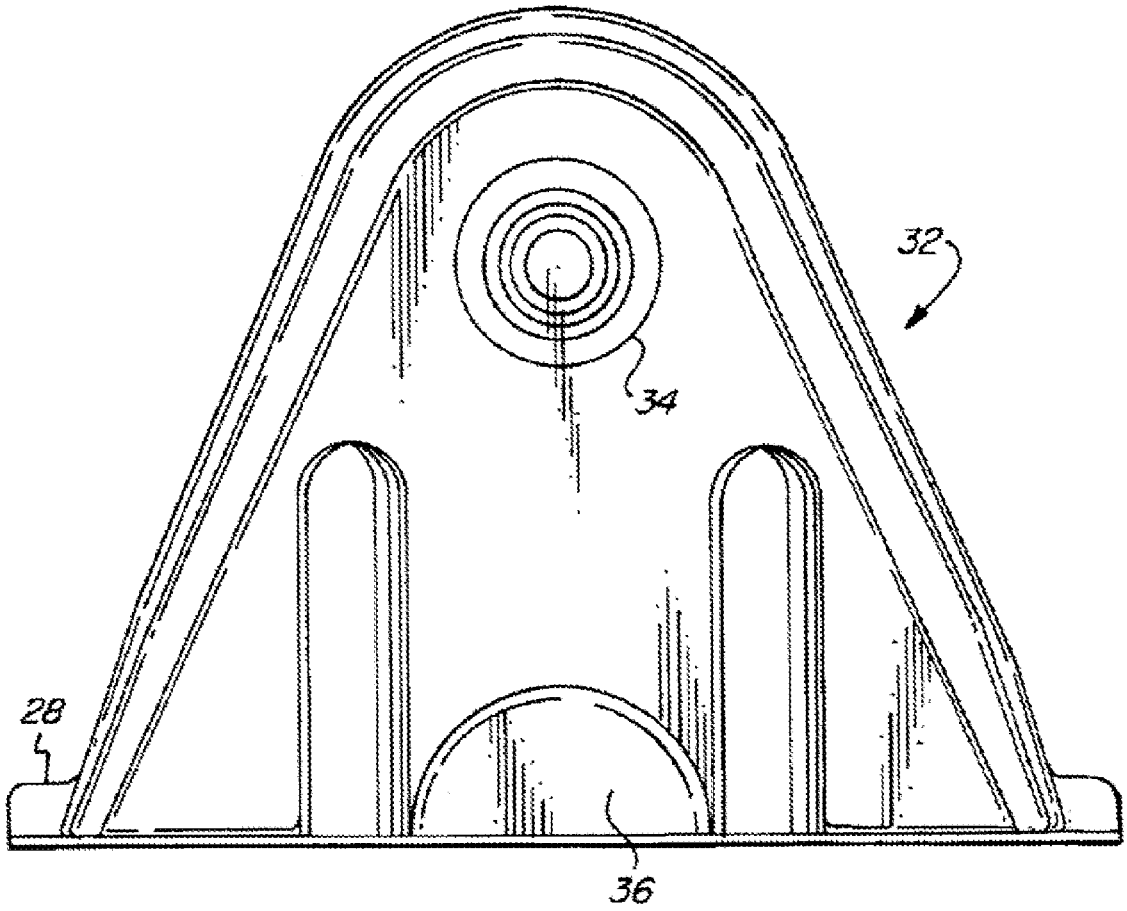
FIG. 3 is an elevational view of an end wall as used in an embodiment.

FIG. 3 depicts an illustration of an end wall 32 that may be utilized in conjunction with the gallery 10. The end wall 32 may be furnished with concentric perforations 34 provided so that a hole may be cut into the end wall 32 to the size of a feed pipe. In addition, the end wall may have a perforation 36, located at the base of the end wall 32, to facilitate the flow of effluent and solids, in the case of wastewater management, or storm water runoff, in the case of storm water management, from one gallery to the next. As the galleries may be utilized in many varying applications, the end wall 32 may provide structural support to the gallery 10 when, for instance, the system is installed under a parking area or a roadway where strong compression forces may be encountered.

Figure 4:
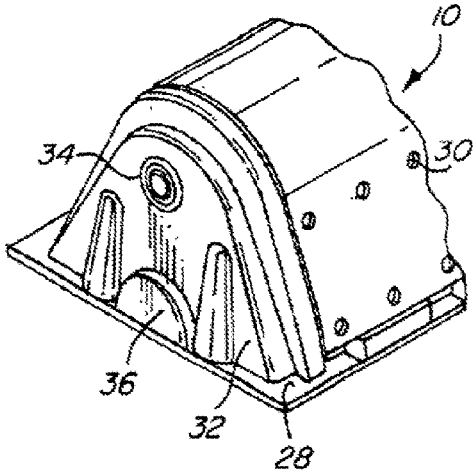
FIG. 4 is a perspective view of an integral end wall in one embodiment of the invention.
Figure 5:
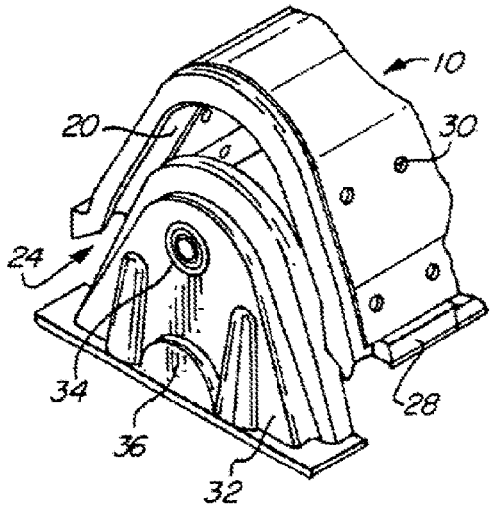
FIG. 5 is a perspective view of a separate end wall attachable to the gallery in another embodiment of the invention.

To that end, the end wall 32 may be either integral to the gallery 10 as depicted in FIG. 4, or in the alternative, the end wall 32 may be detachably connectable to the gallery 10 as depicted in FIG. 5. Where the end wall 32 is detachably connectable to the gallery 10 as illustrated in FIG. 5, the end wall 32 may simply be attached to the gallery 10 in the same manner as attaching galleries in an end-to-end fashion, namely by fitting the end wall 32 into the exposed underneath of the at least one upstanding rib 20 at the first end 24 of the gallery 10.

Figure 6:
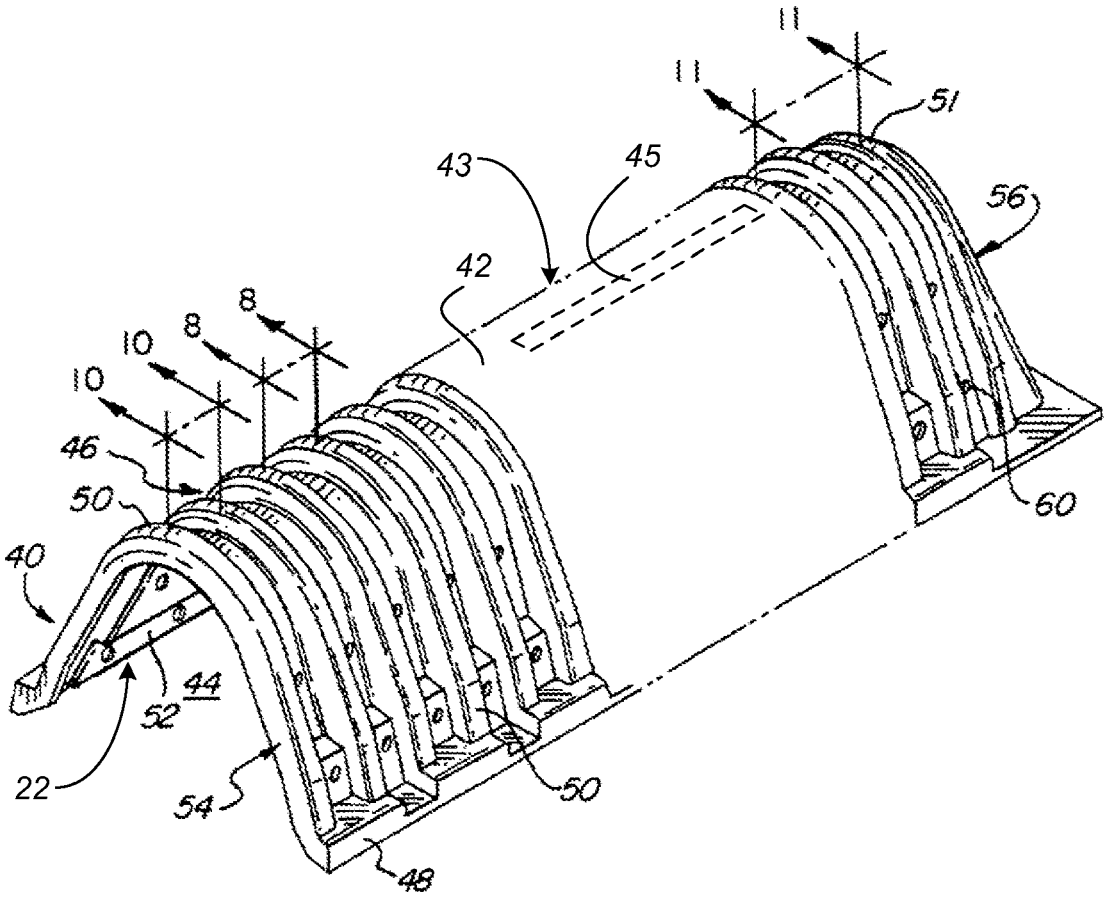
FIG. 6 is a perspective drawing of a second embodiment of the invention.

FIG. 6 illustrates another embodiment of gallery 10 having a multi-wall construction. Plastic gallery 40 comprises an elongated section 42 that forms an interior space 44. The gallery 40 comprises a corrugated plastic arched exterior layer 46 that terminates at the bottom portion of the gallery 40 with a flange 48, the exterior layer 46 running transversely to the length of the elongated section 42 forming a plurality of spaced apart upstanding ribs 50. The gallery 10 further includes an arched inner layer 52 forming a smooth continuous surface over the interior of the elongated section 42.

Figure 7:
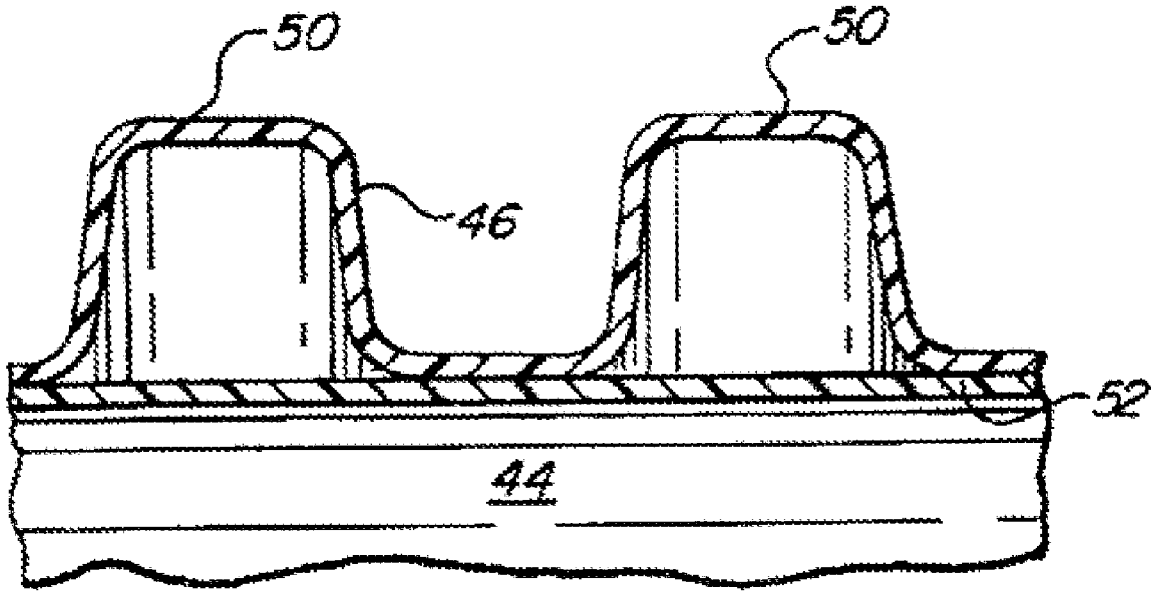
FIG. 7 is a cross-sectional view of the section of FIG. 6 along line 8-8.

FIG. 7 is a cross-section of the gallery of FIG. 6, showing the exterior layer 46, and the protective inner layer 52. Both exterior layer 46 and inner layer 52 may comprise polyethylene material, however, inner layer 52 is treated to resist chemicals that are corrosive to polyethylene. For example, inner layer 52 may comprise polyethylene that has been treated to resist a warm or hot caustic that would normally cause damage to untreated polyethylene. As illustrated, inner layer 52 may be provided as a relatively thin layer that presents a smooth interior surface. Alternatively, inner layer 52 could be provided such that it substantially follows the contour of the corrugated exterior layer 46. In any event, inner layer 52 would be treated to resist degradation due to exposure to a particular chemical.

Figure 8:
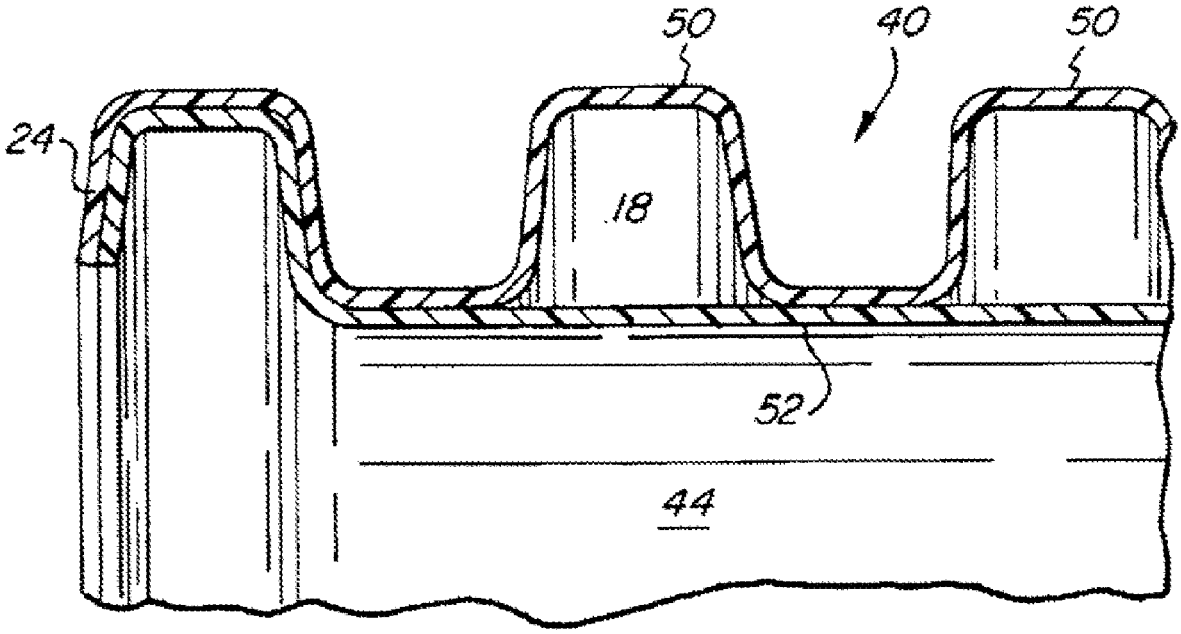
FIG. 8 is a cross-sectional view of the section of FIG. 6 along line 10-10.
Figure 9:
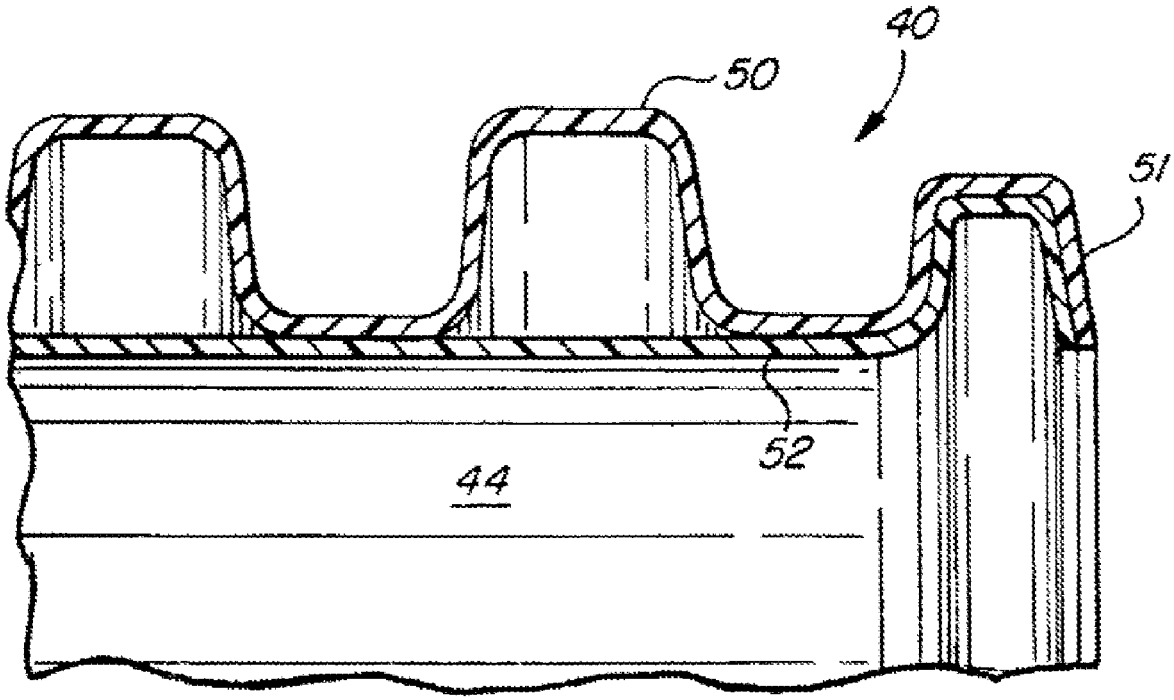
FIG. 9 is a cross-sectional view of the section of FIG. 6 along line 11-11.

Referring to FIGS. 6, 8, and 0, inner layer 52 extends from the second end 56, but at first end 54, inner layer 52 conforms to corrugated exterior layer 46 (or, alternatively, is terminated before the first end 54) thereby providing an open area below at least one upstanding rib 50 at the first end 54. The exposed upstanding ribs 50 at the first end 54 are larger in size than exposed upstanding rib 51 at the second end 56. Galleries 40 can be connected in an end-to-end fashion as an exposed upstanding rib 50 at the first end 54 of a first gallery 40 is fitted over the exposed upstanding rib 51 at the second end 56 of a second gallery 40. Alternatively, the gallery 40 may have multiple exposed upstanding ribs located at each end of the gallery 40.

In one embodiment, gallery 40 may be provided with perforations 60, distributed along the length of the elongated section 42. It is further contemplated that, while not illustrated in connection with FIG. 1, perforations may also be provided in conjunctions with gallery 10. The end wall 32 illustrated in FIGS. 3-5 may also be utilized with the gallery 40 in the same manner as described for use with the gallery 10 illustrated in FIG. 1.

Figure 10:
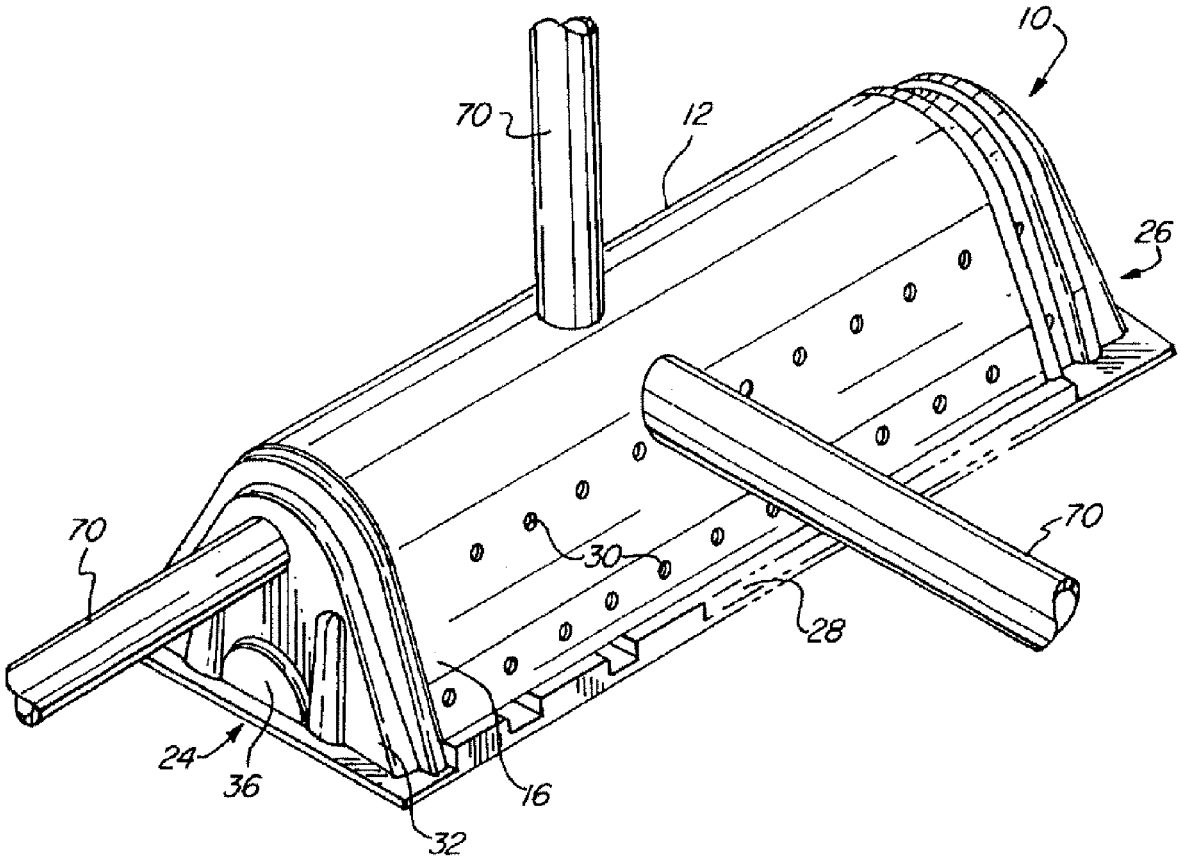
FIG. 10 is a perspective view of an embodiment of the present invention according to FIG. 1.

FIG. 10 illustrates an embodiment of gallery 10 in an installed configuration. Gallery 10 is provided with drain and/or feed conduits 70 shown entering the gallery 10 at various locations. For example, the drain conduit 70 may feed into the first end 24 of the elongated section 12 through the end wall 32. Alternatively, the drain conduit may feed into the elongated section 12 through the side inlet or through a top inlet. The acceptable feed points into the gallery 10 may be indicated by perforations located on the side and top of the elongated section in the same manner as indicated in FIG. 3 showing concentric diameters, which may be cut according to the diameter of the pipe. It should be noted that, although the embodiment of FIG. 1 is shown in FIG. 10, the alternate embodiment in FIG. 6 may also be utilized when feeding pipes into the elongated section from the side and/or the top, which would also include concentric perforations to indicate where to feed the pipe into the elongated section.

It is still further contemplated that the embodiment described in connection with either FIG. 1 or 6 could be provided with an interior layer comprising a material having dielectric or magnetic properties. For example, as stated earlier, it is know to determine the Dielectric Constant (DC) of a material where a DC conductivity measurement may be used to measure the level of a liquid. Polyethylene plastic has DC=2.2 at 68° F. in a solid state. Accordingly, DC conductivity measurements using R.F./admittance and pulse wave technology can be used for liquid level measurements in gallery 10, 40. Accordingly, gallery 10, 40 may be provided having an interior polyethylene layer 22 that is used to determine the level of a liquid residing in the gallery at a particular temperature by performing a DC conductivity measurement. Interior layer 22 may be used on one or more galleries coupled to together in an end-to-end fashion and/or in various columns and rows to determine a liquid level throughout the gallery field. The dielectric measurement could be used to generate a level signal indicative of a level of fluid in the gallery, which could be sent to either a local or remote location for monitoring, including to, for example, a computer (not shown) accessible via a network connection.

It is further contemplated that a top portion 13, 43 of the arched body 12, 42 may be provided having a white color so as to reflect a relatively large portion of the energy from sunlight away from the gallery 10, 40 so as to reduce heating of the body 12, 42.

The gallery 10, 40 may also be provided with a metallic portion 15, 45 positioned on the elongated arched body 12, 42. In this manner, when the galleries 10, 40 are buried, the metallic portion 15, 45 allows an individual to locate the buried galleries 10, 40 by simply using a metal detector.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A multi-layer gallery having an elongated arched body and first and second ends, the elongated arched body forming an elongated arched interior space with an open bottom for liquid to flow therethrough, the multi-layer gallery comprising:

a first exterior layer having a hardness ($H_1$) that extends the substantially the length of the gallery;

a second inner layer forming a plurality of spaced apart upstanding ribs along a length of the gallery, said second layer having a hardness ($H_2$);

said hardness ($H_1$) of said first exterior layer being lower than the hardness ($H_2$) of said second inner layer; and a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

2. The multi-layer gallery of claim 1 wherein said starting rib is larger than the end rib.

3. The multi-layer gallery of claim 1 further comprising an end wall located at the second end of the gallery.

4. The multi-layer gallery of claim 3 wherein said end wall is integral to the gallery.

5. The multi-layer gallery of claim 3 wherein said end wall is detachably connectable to the second end of the gallery.

6. The multi-layer gallery of claim 1 wherein said first exterior layer is formed as a smooth exterior layer overlaying said second inner layer.

7. The multi-layer gallery of claim 1 wherein a top portion of the arched body is provided having a white color.

8. The multi-layer gallery of claim 1 further comprising a metallic portion positioned on the elongated arched body such that the body may be detected when buried.

9. A multi-layer polyethylene gallery having an elongated arched body and first and second ends, the elongated arched body forming an elongated arched interior space with an open bottom for liquid to flow therethrough, the multi-layer gallery comprising:

a first exterior layer forming a plurality of spaced apart upstanding ribs along a length of the gallery;

a second inner layer extending substantially the length of the gallery;

said second inner layer treated to resist degradation by a selected substance that is caustic to polyethylene such that the multi-layer polyethylene gallery can be used to disperse substances that may be harmful to polyethylene without degradation to the gallery; and a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

10. The multi-layer gallery of claim 9 wherein said starting rib is larger than the end rib.

11. The multi-layer gallery of claim 10 further comprising an end wall located at the second end of the gallery.

12. The multi-layer gallery of claim 11 wherein said end wall is integral to the gallery.

13. The multi-layer gallery of claim 11 wherein said end wall is detachably connectable to the second end of the gallery.

14. The multi-layer gallery of claim 9 wherein said second inner layer is formed as a smooth inner layer overlaying an inner surface of said first exterior layer.

15. The multi-layer gallery of claim 9 wherein a top portion of the arched body is provided having a white color.

16. The multi-layer gallery of claim 9 further comprising a metallic portion positioned on the elongated arched body such that the body may be detected when buried.

17. A multi-layer gallery having an elongated arched body and first and second ends, the elongated arched body forming an elongated arched interior space with an open bottom for liquid to flow therethrough, the multi-layer gallery comprising:

a first exterior polyethylene layer forming a plurality of spaced apart upstanding ribs along a length of the gallery;

a second inner polyethylene layer having a know Dielectric Constant (DC) at a given temperature;

a DC conductivity measurement of the second inner polyethylene layer that is indicative of a level of liquid in the gallery at a given point in time;

a level signal generator receiving the DC conductivity measurement and generating a level signal corresponding to the level of liquid in the gallery; and a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

18. The multi-layer gallery of claim 17 wherein said level signal generator is coupled to a computer and said level signal is transmitted to said computer.

19. The multi-layer gallery of claim 18 wherein said computer is coupled to a network.

20. The multi-layer gallery of claim 17 wherein said starting rib is larger than the end rib.

21. The multi-layer gallery of claim 17 further comprising an end wall located at the second end of the gallery.

22. The multi-layer gallery of claim 21 wherein said end wall is integral to the gallery.

23. The multi-layer gallery of claim 21 wherein said end wall is detachably connectable to the second end of the gallery.

24. The multi-layer gallery of claim 17 wherein a top portion of the arched body is provided having a white color.

25. The multi-layer gallery of claim 17 further comprising a metallic portion positioned on the elongated arched body such that the body may be detected when buried.

26. A multi-layer gallery having an elongated arched body and first and second ends, the elongated arched body forming an elongated arched interior space with an open bottom for liquid to flow therethrough, the multi-layer gallery comprising:

a first exterior layer having a hardness ($H_1$) that extends the substantially the length of the gallery;

a second inner layer forming a plurality of spaced apart upstanding ribs along a length of the gallery, said second layer having a hardness ($H_2$);

said hardness ($H_1$) of said first exterior layer being lower than the hardness ($H_2$) of said second inner layer;

a third interior layer extending substantially the length of the gallery;

said third interior layer treated to resist degradation by a selected substance that is caustic to polyethylene such that the multi-layer polyethylene gallery can be used to disperse substances that may be harmful to polyethylene without degradation to the gallery; and a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

27. A multi-layer gallery having an elongated arched body and first and second ends, the elongated arched body forming an elongated arched interior space with an open bottom for liquid to flow therethrough, the multi-layer gallery comprising:

a first exterior layer having a hardness ($H_1$) that extends the substantially the length of the gallery;

a second inner layer forming a plurality of spaced apart upstanding ribs along a length of the gallery, said second layer having a hardness ($H_2$);

said hardness ($H_1$) of said first exterior layer being lower than the hardness ($H_2$) of said second inner layer;

a third interior polyethylene layer having a know Dielectric Constant (DC) at a given temperature;

a DC conductivity measurement of the third interior polyethylene layer that is indicative of a level of liquid in the gallery at a given point in time;

a level signal generator receiving the DC conductivity measurement and generating a level signal corresponding to the level of liquid in the gallery; and a connecting mechanism located at the first and second end of the multi-layer gallery for connecting the gallery together with another gallery in an end-to-end relationship, the connecting mechanism comprising a starting rib located at the first end of the gallery, and an end rib located at the second end of the gallery, such that a first gallery and a second gallery may be connected together by overlapping a starting rib of the first gallery over an end rib of the second gallery.

* * * * *